US010058975B2

(12) United States Patent
Brown

(10) Patent No.: US 10,058,975 B2
(45) Date of Patent: Aug. 28, 2018

(54) IN-SITU TEMPERATURE CONTROL DURING CHEMICAL MECHANICAL POLISHING WITH A CONDENSED GAS

(71) Applicant: Applied Materials, Inc., Santa Clara, CA (US)

(72) Inventor: Brian J. Brown, Palo Alto, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 32 days.

(21) Appl. No.: 15/410,512

(22) Filed: Jan. 19, 2017

(65) Prior Publication Data

US 2017/0232572 A1 Aug. 17, 2017

Related U.S. Application Data

(60) Provisional application No. 62/294,420, filed on Feb. 12, 2016.

(51) Int. Cl.
*B24B 37/015* (2012.01)
*B24B 49/14* (2006.01)
(Continued)

(52) U.S. Cl.
CPC ..... *B24B 37/015* (2013.01); *B24B 37/34* (2013.01); *B24B 49/14* (2013.01); *B24B 55/02* (2013.01); *B24C 1/003* (2013.01)

(58) Field of Classification Search
CPC ..... B24B 37/015; B24B 49/14; B24B 55/02; B24C 1/003
(Continued)

(56) References Cited

U.S. PATENT DOCUMENTS 5,088,242 A * 2/1992 Lubbering ..... B23Q 11/10 451/359
5,765,394 A 6/1998 Rhoades
(Continued)

FOREIGN PATENT DOCUMENTS

JP 2013-042066 A 2/2013
KR 10-2009-0046468 A 5/2009
(Continued)

OTHER PUBLICATIONS

International Search Report and Written Opinion for International Application No. PCT/US2017/014105 dated May 1, 2017.
(Continued)

*Primary Examiner* — Eileen Morgan
(74) *Attorney, Agent, or Firm* — Patterson + Sheridan LLP

(57) ABSTRACT

Implementations of the present disclosure generally relate to planarization of surfaces on substrates and on layers formed on substrates, including an apparatus for in-situ temperature control during polishing, and methods of using the same. More specifically, implementations of the present disclosure relate to in-situ temperature control with a condensed gas during a chemical-mechanical polishing (CMP) process. In one implementation, the method comprises polishing one or more substrates against a polishing surface in the presence of a polishing fluid during a polishing process to remove a portion of a material formed on the one or more substrates. A temperature of the polishing surface is monitored during the polishing process. Carbon dioxide snow is delivered to the polishing surface in response to the monitored temperature to maintain the temperature of the polishing surface at a target value during the polishing process.

19 Claims, 4 Drawing Sheets

(51) Int. Cl.
*B24B 55/02* (2006.01)
*B24B 37/34* (2012.01)
*B24C 1/00* (2006.01)

(58) Field of Classification Search
USPC ..... 451/7, 449
See application file for complete search history.

(56) References Cited

U.S. PATENT DOCUMENTS 5,868,003 A 2/1999 Simas et al.
6,023,941 A 2/2000 Rhoades
6,151,913 A 11/2000 Lewis et al.
6,543,251 B1 4/2003 Gasteyer, III et al.
9,005,999 B2 * 4/2015 Xu ..... H01L 21/302 438/16
2002/0039874 A1 * 4/2002 Hecker, Jr. ..... B24B 37/013 451/7
2002/0058469 A1 * 5/2002 Pinheiro ..... B24B 37/04 451/526
2005/0042877 A1 2/2005 Salfelder et al.
2009/0258573 A1 * 10/2009 Muldowney ..... B24B 37/24 451/5
2010/0047424 A1 2/2010 Cousin et al.
2010/0227435 A1 * 9/2010 Park ..... B24B 37/015 438/102
2013/0023186 A1 1/2013 Motoshima et al.
2013/0045596 A1 2/2013 Eda et al.
2014/0187122 A1 7/2014 Ishibashi

FOREIGN PATENT DOCUMENTS

WO 02/17411 A1 2/2002
WO 2014/113220 A1 7/2014

OTHER PUBLICATIONS

Souvik Banerjee, et al., Post CMP Aqueous and CO2 Cryogenic Cleaning Technologies for Low k and Copper Integration, CMPUG Symposium, Poster Abstract, Jan. 2015, 2 pages.

* cited by examiner

IN-SITU TEMPERATURE CONTROL DURING CHEMICAL MECHANICAL POLISHING WITH A CONDENSED GAS

CROSS-REFERENCE TO RELATED APPLICATIONS

This application claims benefit of U.S. Provisional Patent Application Ser. No. 62/294,420, filed Feb. 12, 2016, which is incorporated herein by reference in its entirety.

BACKGROUND

Field

Implementations of the present disclosure generally relate to planarization of surfaces on substrates and on layers formed on substrates, including an apparatus for in-situ temperature control during polishing, and methods of using the same. More specifically, implementations of the present disclosure relate to in-situ temperature control with a condensed gas during a chemical-mechanical polishing (CMP) process.

Description of the Related Art

In the fabrication of integrated circuits and other electronic devices, multiple layers of conducting, semiconducting, and dielectric materials are deposited on or removed from a surface of a substrate. The substrate may be a semiconductor substrate or a glass substrate. As layers of material are sequentially deposited on and removed from the substrate, the uppermost surface of the substrate may become non-planar and call for planarization and/or polishing before further patterning. Planarization and polishing are procedures where previously deposited material is removed from the feature side of a substrate to form a generally even, planar, or level surface. Planarization and polishing are useful in removing unwanted surface topography and surface defects, such as rough surfaces, agglomerated materials, crystal lattice damage, scratches, and contaminated layers or materials. Planarization is also useful in forming features on a substrate by removing excess material deposited to fill the features, and to provide an even surface for subsequent patterning processes.

Chemical mechanical planarization, or chemical mechanical polishing (CMP), is a common technique useful in removing unwanted surface topography, or in forming features on a substrate by removing excess deposited material used to fill the features and to provide an even or level surface for subsequent deposition and processing. In conventional CMP techniques, a substrate carrier or polishing head mounted on a carrier assembly positions a substrate secured therein in contact with a polishing pad mounted on a platen in a CMP apparatus. The carrier assembly provides a controllable pressure to the substrate against the polishing pad. An external driving force moves the polishing pad relative to the substrate. Thus, the CMP apparatus creates polishing or rubbing movement between the surface of the substrate and the polishing pad while dispersing a polishing composition, or slurry, to affect both chemical activity and mechanical activity. This polishing or rubbing movement generates heat. Because the polishing pad is generally constructed of a polymer with poor thermal conductivity and the substrate is forced against the polishing pad by a polymer membrane in the carrier assembly, the heat generated increases the temperature of the substrate during the polishing process. High and unstable temperatures can lead to removal rate variations over time and across the wafer, which will affect the ability to control the final thickness of the material at the end of the process. In addition, for many CMP processes, higher temperatures will degrade the planarization efficiency, selectivity, or both leading to poor topography and within die planarization.

One conventional method of maintaining a stable temperature during CMP involves cooling the platen with chilled fluid via channels in the platen. However, the insulating nature of the polishing pad positioned between the substrate and the platen reduce the effectiveness of this approach. Another conventional method involves adding water or misting water to the platen to remove heat via conduction or evaporation. Dilution of the polishing slurry with water reduced the polishing rate. Removal of water from the polishing slurry is often difficult and expensive and runs the risk of drying the pad, leading to substrate defect issues.

Therefore, there is a need in the art for a method and apparatus for improved in-situ temperature control during a CMP process.

SUMMARY

Implementations of the present disclosure generally relate to planarization of surfaces on substrates and on layers formed on substrates, including an apparatus for in-situ temperature control during polishing, and methods of using the same. More specifically, implementations of the present disclosure relate to in-situ temperature control with a condensed gas during a chemical-mechanical polishing (CMP) process. In one implementation, a method for chemical mechanical polishing (CMP) is provided. The method comprises urging one or more substrates having a material disposed thereon against a polishing surface in the presence of a polishing fluid during a polishing process to remove a portion of the material. The method further comprises monitoring a temperature of the polishing surface during the polishing process. The method further comprises delivering carbon dioxide snow to the polishing surface in response to the monitored temperature to maintain the temperature of the polishing surface at a target value in the presence of the polishing fluid during the polishing process.

In another implementation, a processing station is provided. The processing station comprises a chamber body, a rotatable platen disposed in the chamber body, a substrate carrier head configured to retain a substrate against a surface of a polishing pad, wherein the substrate carrier head is disposed in the chamber body at a first location, a carbon dioxide snow delivery system configured to deliver carbon dioxide snow to a polishing surface of the polishing pad, wherein the carbon dioxide snow delivery system is disposed in the chamber body at a second location, the second location disposed radially about a central axis of the platen and located between the first location and a third location, and a polishing fluid delivery system disposed in the chamber body at a third location. The second location is disposed radially about a central axis of the rotatable platen and located between the first location and the third location. The third location is disposed radially about the central axis of the rotatable platen and located between the second location and the first location.

In yet another implementation, a method for CMP is provided. The method comprises urging one or more substrates having a material disposed thereon against a polishing surface in the presence of a polishing fluid during a polishing process to remove a portion of the material. The method further comprises monitoring a temperature of the polishing surface during the polishing process. The method further comprises delivering carbon dioxide snow to the polishing surface in response to the monitored temperature to maintain the temperature of the polishing surface at a target value in the presence of the polishing fluid during the polishing process. The method further comprises evaporating the carbon dioxide snow from the polishing surface.

BRIEF DESCRIPTION OF THE DRAWINGS

So that the manner in which the above-recited features of the present disclosure can be understood in detail, a more particular description of the implementations, briefly summarized above, may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

Figure 1:
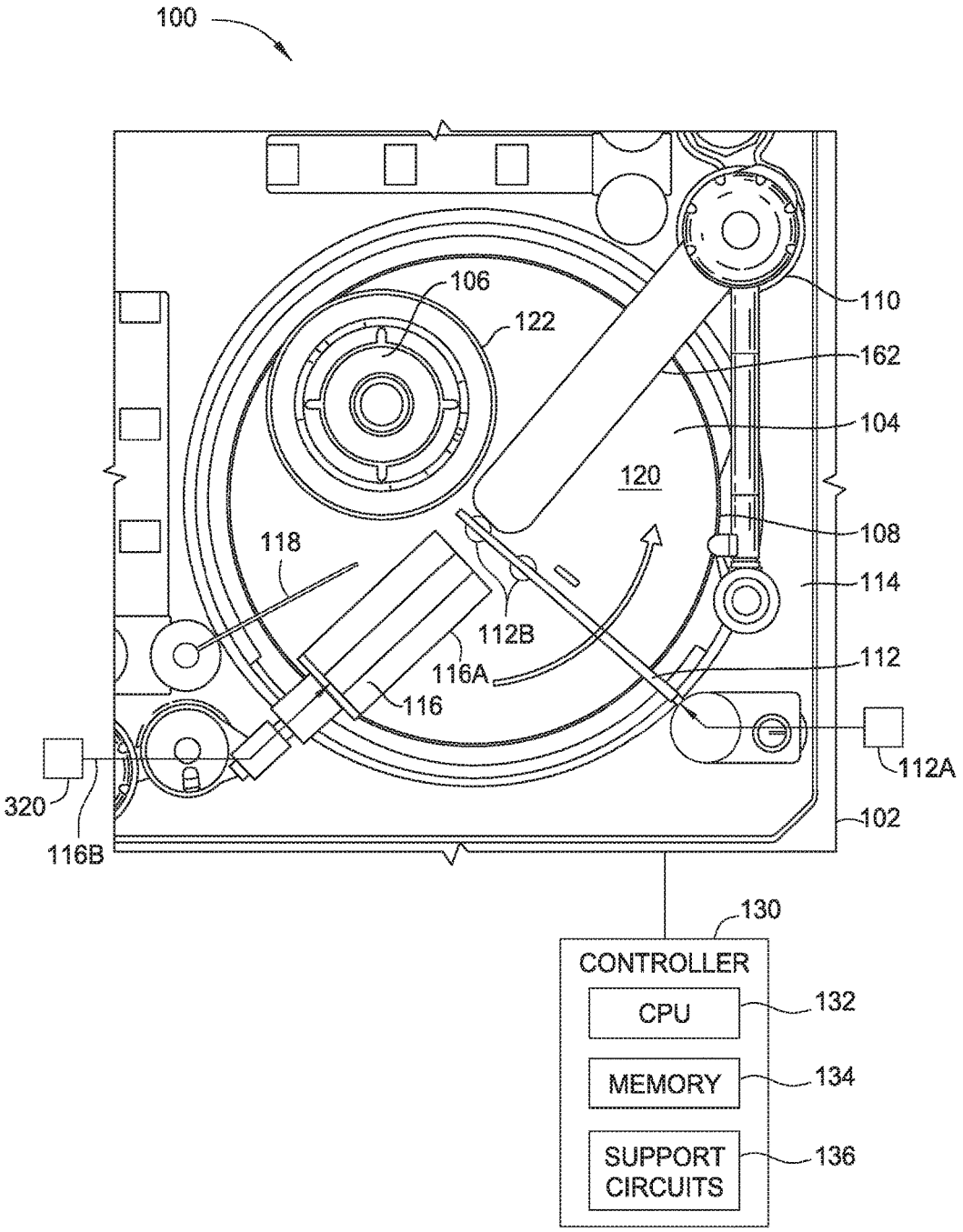
FIG. 1 is a top plan view of an exemplary processing station having a temperature control system, according to implementations described herein.
Figure 2:
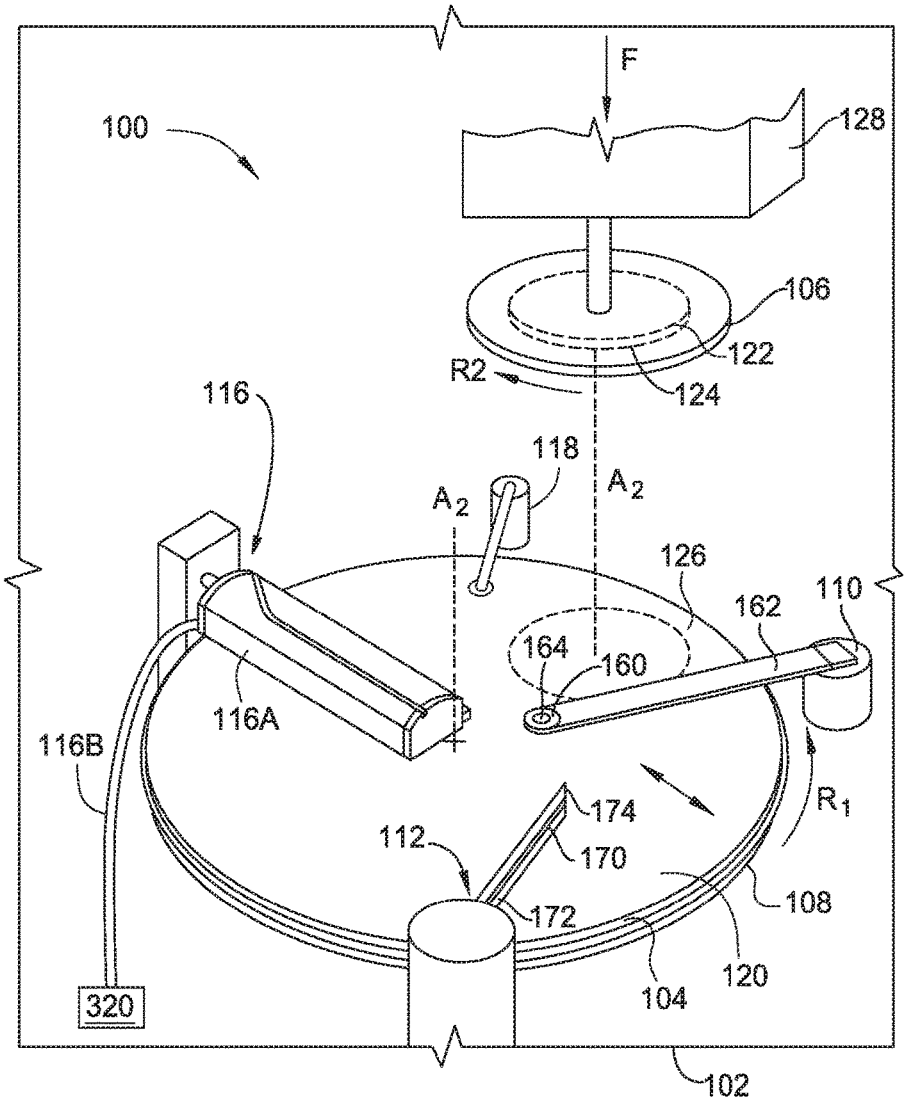
FIG. 2 is a top perspective view of an exemplary CMP system employing a temperature control system according to implementations described herein.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Implementations of the present disclosure generally relate to planarization of surfaces on substrates and on layers formed on substrates, including an apparatus for in-situ temperature control during polishing, and methods of using the same. More specifically, implementations of the present disclosure relate to in-situ temperature control with a condensed gas during a chemical-mechanical polishing (CMP) process. Certain details are set forth in the following description and in FIGS. 1-4 to provide a thorough understanding of various implementations of the disclosure. Other details describing well-known structures and systems often associated with substrate polishing and temperature control using condensed gases are not set forth in the following disclosure to avoid unnecessarily obscuring the description of the various implementations.

Many of the details, dimensions, angles and other features shown in the Figures are merely illustrative of particular implementations. Accordingly, other implementations can have other details, components, dimensions, angles and features without departing from the spirit or scope of the present disclosure. In addition, further implementations of the disclosure can be practiced without several of the details described below.

Implementations described herein will be described below in reference to a CMP process that can be carried out using a CMP system, such as a REFLEXION® LK CMP system and REFLEXION® LK Prime™ CMP system available from Applied Materials, Inc. of Santa Clara, Calif. Other tools capable of performing polishing processes may also be adapted to benefit from the implementations described herein. In addition, any system enabling the polishing processes described herein can be used to advantage. The apparatus description described herein is illustrative and should not be construed or interpreted as limiting the scope of the implementations described herein.

Polishing rate and uniformity depend in a complex fashion on a number of process variables at the wafer-pad interface, such as contact pressure, relative velocity between the polishing pad and wafer surface, hardness (durometer) of the polishing pad, properties of the slurry, and rate of chemical reaction. Many of these variables are temperature dependent, particularly the chemical reaction rate, although the polishing pad durometer and slurry viscosity, for example, are also temperature dependent.

Because of the temperature dependence of process variables in CMP, it is desirable to regulate the temperature in order to stabilize these process variables. It is additionally desirable to provide precise control of temperature over the range of interest, i.e., a range of about 40 degrees F. to 176 degrees Fahrenheit (about 4 degrees Celsius to about 80 degrees Celsius). It is ultimately desirable to provide a controlled distribution of temperature locally across a wafer surface and from wafer-to-wafer.

Implementations of the present disclosure provide apparatus and methods for providing a condensed gas onto a polishing pad during a polishing process to control the pad temperature. In some implementations, the condensed gas is $CO_2$ in the form of dry ice "snow." Delivering pressurized $CO_2$ through nozzles is used to cool the pressurized $CO_2$ enough to solidify it to form the dry ice "snow." The formed "snow" (e.g., solid $CO_2$), which is delivered onto the polishing pad or platen, absorbs the heat produced during the polishing process as the dispensed $CO_2$ material warms (e.g., "sensible heat") and the solid $CO_2$ sublimates into $CO_2$ gas (e.g., "latent heat" of sublimation). Since the $CO_2$ is not left as a liquid, the polishing slurry is not diluted. The $CO_2$ can be dispensed with a stainless steel manifold with stainless steel nozzles oriented toward the pad. A diffuser apparatus may be employed to reduce the impact velocity of the $CO_2$ "snow" against the platen. This reduction in impact velocity reduces the production of "mist" that would carry portions of the slurry throughout the CMP process area, leading to dried slurry forming on various parts of the CMP tool and long-term "fall-on" type of slurry scratching issues. The mass flow rate of $CO_2$ snow dispensed can be controlled so that the components of the slurry (e.g., water) on the platen does not freeze, which could lead to slurry agglomeration and scratching. By using an in-situ temperature sensor assembly on the pad surface, e.g. a pyrometer, the rate of $CO_2$ snow dispensed can be adjusted, controlled, or both adjusted and controlled to maintain a chosen temperature, thus allowing for closed-loop temperature control.

Although the implementations described herein are discussed in relation to condensed gases and $CO_2$ snow, other fluids, for example, cryogenic fluids may be used with the implementations described herein. The "cryogenic fluid" comprises liquefied gas and may be a liquefied pure gas, a mixture of liquefied gases, or a liquid/solid mixture comprising liquefied first gas and solidified second gas, typically in the form of a cryogenic slurry or slush. In some implementations, the cryogenic fluid is a cryogenic liquid such as liquid oxygen (LOX), liquid hydrogen, liquid nitrogen (LIN), liquid helium, liquid argon (LAR), liquid neon, liquid krypton, liquid xenon, and liquid methane, or appropriate mixtures thereof necessary to form a particular gas mixture. In other implementations, the cryogenic fluid is a liquid/solid mixture comprising a liquefied first gas and a solidified second gas. The liquefied first gas may be one or more of the cryogenic liquids listed above, and the solidified second gas is typically solid $CO_2$ or $N_2O$, as appropriate to form a particular gas mixture (e.g., $CO_2$ snow and liquid nitrogen).

The liquid/solid mixture is typically fluid enabling the mixture to be sprayed. Depending on the relative proportions of liquefied gas(es) and solidified gas(es), the consistency and appearance of the mixture may range from a thick, creamy substance (not unlike whipped cream or white petrolatum) to a thin, milky substance. In some implementations, the range of viscosity of the mixture is typically from about 1 cPs (for thin, milky mixtures) to about 10,000 cPs (for thick, creamy mixtures). The viscosity may be from about 1,000 to about 10,000 cPs. In some implementations, the mixture is composed of finely divided solid particles suspended in a liquid phase. The liquid/solid mixture may be described as a cryogenic slurry or slush.

FIG. 1 is a top plan view of an exemplary CMP processing station 100 having a temperature control system according to implementations described herein. The exemplary CMP processing station 100 is configured to perform a polishing process, such as a CMP process. The exemplary CMP processing station 100 is further configured to control the temperature of the CMP process. The CMP processing station 100 may be a stand-alone unit or part of a larger processing system. Examples of a larger processing system that the CMP processing station 100 may be utilized with include REFLEXION®, REFLEXION® LK™, REFLEXION® LK Prime™, and MIRRA MESA® polishing systems, all available from Applied Materials, Inc. located in Santa Clara, Calif. It is contemplated that other processing stations may be adapted to benefit from the disclosure, including those from other equipment manufactures.

The CMP processing station 100 is located in a process chamber body 102. The CMP processing station 100 includes a substrate carrier head 106, a platen 108, an optional conditioning module 110, and a polishing fluid delivery assembly 112 (such as a slurry delivery assembly). The platen 108, the conditioning module 110, and the polishing fluid delivery assembly 112 may be mounted to a base 114 of the CMP processing station 100.

The platen 108 supports a polishing pad 104. The platen 108 is rotated by a motor (not shown). The polishing pad 104 is rotated relative to a substrate 122 retained in the substrate carrier head 106 during processing. As such, terms such as upstream, downstream, in front, behind, before, and after are generally interpreted relative to the motion or direction of the platen 108 and the polishing pad 104 supported thereon, as appropriate.

The CMP processing station 100 also includes a carbon dioxide snow delivery system 116 and a temperature sensor assembly 118. The platen 108, the conditioning module 110, the polishing fluid delivery assembly 112, the carbon dioxide snow delivery system 116, and the temperature sensor assembly 118 may be mounted to the base 114 of the CMP processing station 100, and located inside the process chamber body 102. In some implementations where the platen 108 and the polishing pad 104 rotate counterclockwise, the polishing fluid delivery assembly 112 may be located upstream of the substrate carrier head 106. The carbon dioxide snow delivery system 116 may be positioned downstream of the substrate carrier head 106 but upstream of the polishing fluid delivery assembly 112. The temperature sensor assembly 118 may be positioned downstream of the substrate carrier head 106 and upstream of the carbon dioxide snow delivery system 116.

The polishing fluid delivery assembly 112 includes one or more nozzles 112B coupled to a polishing fluid source 112A by a delivery line (not shown) and configured to deliver the fluid 126, such as slurry, to the polishing surface 120 of the polishing pad 104. In some implementations, the polishing fluid delivery assembly 112 also includes one or more nozzles 112B coupled to the polishing fluid source 112A by a delivery line (not shown) and configured to deliver rinsing fluid, such as de-ionized water (DIW), to the polishing pad 104.

The carbon dioxide snow delivery system 116 includes one or more nozzles (not shown) that are coupled to a liquid carbon dioxide source 320 by a delivery line 1168. In some implementations, the nozzles are positioned on a lower surface of the arm 116A and are configured to deliver carbon dioxide snow, to the polishing surface 120 of the polishing pad 104.

The temperature sensor assembly 118 may be positioned adjacent to the substrate carrier head 106. The temperature sensor assembly 118 may be positioned at any location within the CMP processing station 100 that is suitable for monitoring the temperature of the platen 108, the polishing surface 120, or both during polishing. The temperature sensor assembly 118 located at polishing surface 120 is oriented to sense the temperature of polishing surface 120 adjacent to the substrate carrier head 106, for example, when the substrate carrier head 106 is in contact with polishing surface 120. In some implementations, the temperature sensor assembly is coupled with the carrier assembly 128 or the substrate carrier head 106. The temperature sensor assembly 118 may be an IR sensor. The temperature sensor assembly 118 may be a pyrometer. It should be understood that the temperature sensor assembly 118 may be any temperature sensor compatible with the polishing process and chemistries used during polishing. The controller 130 can monitor the output of the temperature sensor assembly 118 and can control pump 330.

Referring to FIG. 1, in some implementations, the substrate carrier head 106 is disposed in the process chamber body 102 at a first location, the carbon dioxide snow delivery system 116 is disposed in the process chamber body 102 at a second location, the second location disposed radially about a central axis of the platen 108 between the first location and a third location. In some implementations, the polishing fluid delivery assembly 112 is disposed in the process chamber body 102 at the third location, the third location disposed radially about the central axis of the platen 108 and located between the second location and the first location. In some implementations, the temperature sensor assembly 118 is disposed radially about a central axis of the rotatable platen 108 at a fourth location between the first location and the second location.

Before discussing details of the carbon dioxide snow delivery system 116 and the temperature sensor assembly 118, the operation and other components of the CMP processing station 100 are now introduced to provide context. The polishing pad 104, the conditioning module 110, and the polishing fluid delivery assembly 112 are now discussed in terms of their operation as part of the CMP processing station 100. In this regard, the polishing pad 104 and the substrate carrier head 106 of the CMP processing station 100 may be used to planarize a process surface 124 of the substrate 122. The process surface 124 of the substrate 122 may be planarized by use of physical contact of the process surface 124 of the substrate 122 against the polishing pad 104 and by use of relative motion. The planarization removes unwanted surface topography and surface defects in preparation for subsequent processes where layers of materials are sequentially deposited on and removed from the process surface 124 of the substrate 122. The substrate 122 may be, for example, a semiconductor wafer. During planarization, the substrate 122 may be mounted in the substrate carrier head 106 and the process surface 124 of the substrate 122 is positioned by a carrier assembly 128 of the CMP processing station 100 to contact the polishing pad 104 of the CMP processing station 100. The carrier assembly 128 provides a controlled force F to the substrate 122 mounted in the substrate carrier head 106 to urge the process surface 124 of the substrate 122 against the polishing surface 120 of the polishing pad 104. In this manner, contact is created between the substrate 122 and the polishing pad 104.

Removal of the undesirable topography and surface defects is also accomplished by relative rotational movement between the polishing pad 104 and the substrate 122 in the presence of the fluid 126, such as a polishing fluid or slurry, therebetween. The platen 108 of the CMP processing station 100 supports the polishing pad 104 and provides rotational movement R1 to the polishing pad 104 about an axis of rotation A1. The platen 108 may be rotated by a motor in a base (not shown) of the CMP processing station 100. The carrier assembly 128 may also provide rotational movement R2 about an axis of rotation A2 to the substrate 122 mounted within the substrate carrier head 106. Within the environment of this relative motion is the fluid 126. The polishing surface 120 of the polishing pad 104 may be generally planar, but may also include grooves (not shown) which may improve the performance of the polishing pad 104 by distributing the fluid 126 which is applied to the polishing surface 120 by use of the polishing fluid delivery assembly 112. The fluid 126 may include a chemical composition, typically mixed with an abrasive, for selective removal of material from the process surface 124 of the substrate 122. The material removed from the process surface 124 may include conductive materials (e.g., metallic materials), dielectric materials, polymer materials, composite materials, metal nitride materials or combinations thereof. The polishing fluid delivery assembly 112 may dispose the fluid 126 at one or more radii of the polishing pad 104 before, during, or after relative motion. As one skilled in the art would understand, the polishing pad 104 may include features that would retain the polishing media, e.g. pores and/or polishing pad grooves found in the polishing pad 104. The fluid 126, characteristics of the polishing pad 104, the force F, and the rotational movements R1, R2 create frictional forces and abrasive forces at the process surface 124 of the substrate 122. These frictional forces and the abrasive forces generate heat, which increases the temperature during the polishing process.

The CMP processing station 100 may include other components to enable consistent polishing. With continued reference to FIG. 1 and FIG. 2, during planarization the frictional forces and abrasive forces may also cause wear to the polishing pad 104, which may necessitate periodic roughening (conditioning) to maintain the effectiveness of the polishing pad 104 and ensures consistent polishing rates. In this regard, the processing station 100 may optionally comprise the conditioning module 110 with a conditioning head 160 mounted to one end of a pivot arm 162, and a pad conditioner 164, such as a pad embedded with diamond crystals, mounted to the underside of the conditioning head 160. The pivot arm 162 may be operatively connected to the platen 108, and may maintain the pad conditioner 164 against the polishing pad 104 as the pivot arm 162 sweeps back and forth across the radius of the polishing pad 104 in an arcing motion to condition the polishing pad 104. In this manner, the polishing pad 104 is conditioned to provide consistent polishing rates.

In addition to optional conditioning, the temperature of the polishing pad 104 may be controlled within the processing station 100 by using the carbon dioxide snow delivery system 116. Frequent cooling of the polishing pad 104 is performed with the carbon dioxide snow delivery system 116 to maintain the processing temperature during the polishing process within a chosen range. In one implementation, this temperature control may comprise real-time temperature control. Real-time temperature control does not typically involve removing the substrate 122 mounted within the substrate carrier head 106 from contact with the polishing pad 104 or turning off the supply of the fluid 126 from the polishing fluid delivery assembly 112. In other words, the carbon dioxide snow delivery system 116 may direct carbon dioxide snow at the working polishing surface 120 of the polishing pad 104 in real-time and during the planarization of a substrate 122. As the carbon dioxide snow sublimates (i.e., transitions from the solid to gas phase without passing through the intermediate liquid phase) heat is removed from the polishing surface 120 of the polishing pad 104 reducing the overall temperature of the polishing process.

A controller 130 is provided to facilitate control and integration of the systems of the processing station 100. The controller 130 comprises a central processing unit (CPU) 132, a memory 134, and support circuits 136. The controller 130 is coupled with the various components of the processing station 100 to facilitate control of the planarizing, rinsing fluid delivery, slurry delivery, temperature control, and cleaning.

Now that operation of the processing station 100 has been introduced, the carbon dioxide snow delivery system 116 and the temperature sensor assembly 118 are discussed in detail.

Figure 3:
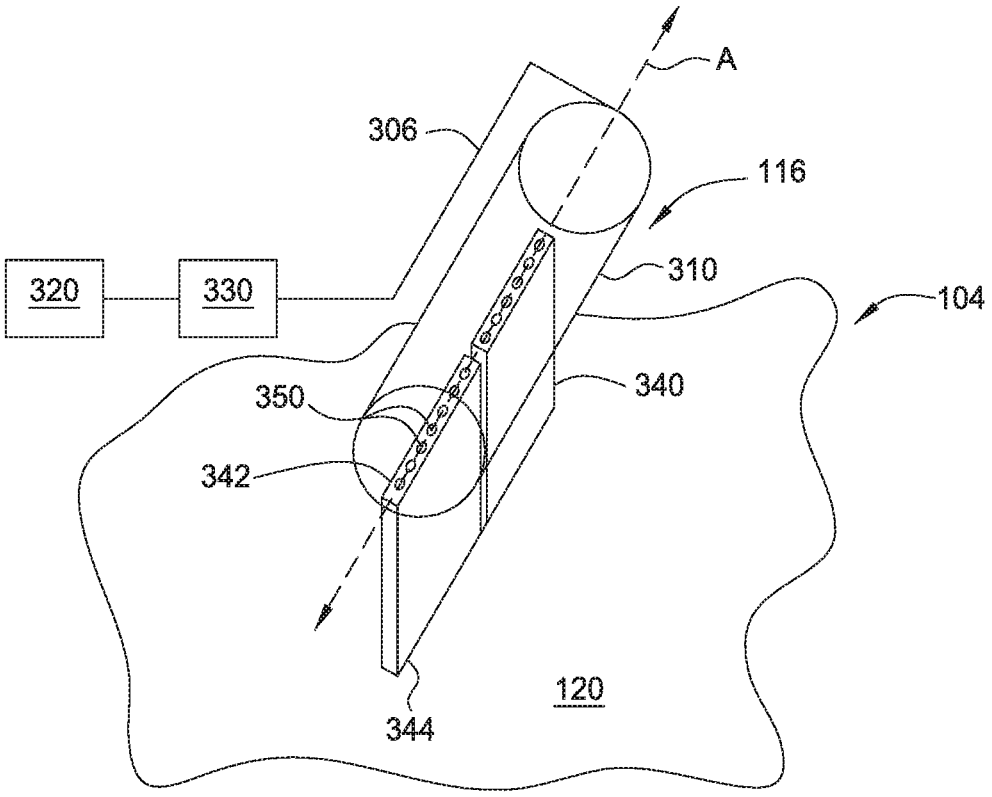
FIG. 3 is a schematic view of a carbon dioxide snow delivery system according to implementations described herein.

FIG. 3 is a schematic view of one example of the carbon dioxide snow delivery system 116 according to implementations described herein. The carbon dioxide snow delivery system 116 includes a manifold 310 for providing a pressurized flow of liquid carbon dioxide. The manifold 310 has an inside diameter and a wall having a thickness, and extends along an axis A. The manifold 310 is made of a material capable of withstanding the pressure of $CO_2$ within the manifold 310. In one implementation, the material of construction is stainless steel. The carbon dioxide snow delivery system 116 includes the liquid carbon dioxide source 320 under high pressure, such as a cylinder or storage tank. In some implementations, a control pump 330 is provided in the line 306 connecting the liquid carbon dioxide source 320 to the manifold 310. One end of the manifold 310 is coupled with the line 306 and the other end of the manifold 310 may be capped.

One or more tubes or nozzles 340 extend from the manifold 310 for delivering the $CO_2$ snow to the polishing surface 120 of the polishing pad 104. Each nozzle 340 has a first end 342 whose peripheral edge is sealed to the outside wall of the manifold 310. The sealing connection can be achieved by welding, brazing, or the like, provided there is no opportunity for carbon dioxide to escape from the joint where the first end 342 meets the manifold 310. In addition, the manner of sealing the first end 342 to the manifold 310 should be capable of withstanding the pressures and temperatures to which the interior of the tube is exposed. Each nozzle 340 has a second end 344 that is exposed to the ambient environment for delivery of the carbon dioxide snow to the polishing surface 120 of the polishing pad 104. Although two nozzles are shown it should be understood that any number of nozzles suitable to deliver the chosen amount or mass flow rate of $CO_2$ snow at the chosen velocity may be used.

The nozzle 340 may have any suitable cross-sectional configuration for delivery of the $CO_2$ snow. Suitable cross-sectional configurations include circular, rectangular, elliptical, oval and square. The nozzle 340 is made of a material capable of withstanding the pressure of $CO_2$ within the nozzle 340. In one implementation, the material of construction is stainless steel. The aspect ratio of each nozzle is typically chosen to avoid flow recirculation of the $CO_2$ snow.

Each nozzle 340 may have the same area and length to ensure uniform deposition of the $CO_2$ snow on the polishing surface 120. However, there could be implementations, in which one or more nozzles might be longer where less uniform deposition is desirable. The shape of each nozzle 340 can be straight as shown in FIG. 3, or can be curved. As shown in FIG. 3, the nozzle 340 can be positioned perpendicular to the polishing surface. In some implementations, the nozzle 340 can be positioned at an acute angle so that the direction in which the $CO_2$ snow emerges from the second end 344 forms an acute angle with the polishing surface 120 of the polishing pad 104.

A plurality of apertures 350 extend through the wall of the manifold 310. The apertures are passages through which the carbon dioxide passes, undergoing pressure reduction as the carbon dioxide passes through so that the carbon dioxide emerging from the apertures 350 includes fine solid-state particles and carbon dioxide vapor.

In operation, liquid carbon dioxide is flowed into the manifold 310 where it reaches the apertures 350. The apertures 350 are sized to allow the expansion of the liquid carbon dioxide. The pressurized $CO_2$ liquid expands into a vapor and solid carbon dioxide. The flow of pressurized $CO_2$ within the nozzles can be adjusted to form large flakes of snow, which depending on the mass flow rate and flow area, can be adjusted to move at a relatively low velocity. In some implementations, this relatively low velocity is desirable to avoid misting of the polishing slurry when delivering the $CO_2$ snow to the polishing surface 120 and contacting the fluid 126. It should be understood that the snow delivery system depicted in FIG. 3 is only exemplary and that other systems, including commercially available systems, may be used to deliver carbon dioxide snow.

Referring again to FIG. 1 and FIG. 2, the polishing fluid delivery assembly 112 may be located within the processing station 100, and may provide fresh, new fluid 126 to the polishing surface 120 of the polishing pad 104. The polishing fluid delivery assembly 112 may comprise a fixed arm 170 having a first end 172 operatively connected to the processing station 100, and a second end 174 held above the polishing surface 120 of the polishing pad 104. The polishing fluid delivery assembly 112 further comprises at least one fluid delivery hole (not shown) connected to a fluid delivery hose (not shown) configured to deliver polishing fluid 126 to the polishing pad 104. Once the fluid 126 is delivered to the polishing pad 104, the fixed arm 170 may evenly spread the fluid 126 over the polishing surface 120 of the polishing pad 104.

Additionally, the location of the processing station 100 elements provides a beneficial order for processing and temperature control of the polishing surface 120. The substrate carrier head 106 is located directly downstream of the polishing fluid delivery assembly 112. The polishing fluid delivery assembly 112 provides the fluid 126 to the polishing surface 120 upstream of the substrate 122 prior to polishing. The polishing fluid delivery assembly 112 delivers and spreads the fluid 126 evenly over the polishing surface 120 of the polishing pad 104 immediately prior to the introduction of the substrate 122 to the fluid 126. The temperature sensor assembly 118 is located downstream of the substrate carrier head 106, and located between the substrate carrier head 106 and the carbon dioxide snow delivery system 116. The carbon dioxide snow delivery system 116 is located downstream of the temperature sensor assembly 118 and located between the polishing fluid delivery assembly 112 and the temperature sensor assembly 118. The temperature sensor assembly 118 measures a temperature of the polishing surface 120 and the carbon dioxide snow delivery system 116 delivers carbon dioxide snow to the fluid 126 disposed on the polishing surface 120. The carbon dioxide snow sublimates transferring heat from the fluid 126, the polishing surface 120, or both. The conditioning module 110, if used, may be beneficially located downstream of the substrate carrier head 106 to condition the polishing surface 120 after the substrate 122 has been polished.

As discussed above, the location of the processing station 100 elements provides a beneficial order for controlling the temperature of the polishing surface 120. The location of the processing station 100 elements allows the polishing surface 120 to remain stable, thus preventing the platen 108 from an unstable increase in temperature.

During the polishing process, which is partially chemical in nature, the polishing rate depends on the temperature of substrate 122 and the polishing surface 120. More specifically, the polishing rate increases when the temperature increases and it decreases when the temperature decreases. Further, it is believed that undesirable side effects will arise from increased temperature such as increased sensitivity of erosion and dishing to device density, resulting in higher within-die (WID) thickness range. Although reducing the temperature of the polishing surface 120 may reduce the polishing rate (and system throughput), the benefit in reduced WID thickness range generally provides a net benefit. A more uniform and repeatable wafer-to-wafer polishing rate and WID thickness range, particularly towards a lower target temperature that improves WID thickness range, in one or more ways as follows.

The polishing process typically applies large forces (e.g., 100-300 lbs) and high relative velocities (e.g., 300-800 ft/min) to the carrier assembly 128 against a moving polishing pad 104, generating a great deal of heat, which conducts though the polishing pad 104 to the platen 108. Without any cooling, the platen 108 and the process chamber body 102 would gradually increase in temperature, leading to a gradual change in polishing rate and WID thickness range over many wafers.

The temperature of the platen 108 can be partly regulated by controlling the temperature of the fluid circulating through fluid circulating channels of the platen 108, which will maintain a constant average temperature of the polishing surface 120 run-to-run. Because the platen 108 is made of a thermally conductive material, the temperature of the fluid in the channels can influence the temperature of the polishing pad. However, the polishing pad 104 may have thermal insulating properties. Therefore, even if the temperature of platen 108 is controlled to lower the temperature of the platen 108, it may not provide as much control of the temperature of polishing surface 120 as chosen within a single polishing run. Additional temperature control at the polishing surface 120 may include delivering carbon dioxide snow at a controlled temperature to polishing surface 120, the fluid 126, or both. In some implementations, the controlled temperature is less than the sublimation temperature at atmospheric pressure (e.g., less than −78.5 degrees Celsius (−109.3 degrees Fahrenheit) at atmospheric pressure). Temperature sensor assembly 118 senses the temperature of the polishing surface 120, the fluid 126, or both. Controller 130 can set a target temperature, and adjust the rate of carbon dioxide snow delivered to the polishing surface 120, the fluid 126, or both to control the temperature of the liquid, e.g., to the target temperature. Thus, the target temperature can be reached and maintained throughout the polishing process and temperature variations can be reduced. In some implementations, the target temperature is in a range of about 4 degrees Celsius to about 90 degrees Celsius (e.g., in the range of about 10 degrees Celsius to about 30 degrees Celsius; in the range of about 40 degrees Celsius to about 50 degrees Celsius; in the range of about 70 degrees Celsius to about 80 degrees Celsius; or in the range of about 30 degrees Celsius to about 80 degrees Celsius).

Typically, during a polishing run of one substrate the temperature of the polishing surface 120 will increase throughout the entire polishing run, usually displaying a rapid increase at the beginning of polishing run and a less rapid increase as the polishing progresses. In some implementations, the platen 108 may be rinsed with cooled deionized water between sequential polishing runs, which brings the polishing pad back to near ambient temperatures at the beginning of each polishing run. In some implementations, the target temperature used by controller 130 can be selected by monitoring a "good" polishing run to examine temperature variation throughout the run as a function of time, while at a fixed relative velocity of substrate 122 to the polishing surface 120. This measured temperature can be selected as the target temperature for similar runs. Thus, controller 130 can control the relative velocity between substrate 122 and the polishing surface 120, so that the temperature of the polishing surface follows the measured temperature curve of a good polishing run. Thus, controller 130 tends to ensure that the averaged polishing rate of each polishing run is repeatable, and thus leads to consistent results. A "good polishing run" occurs when temperature control leads to target removal rate and WID.

Figure 4:
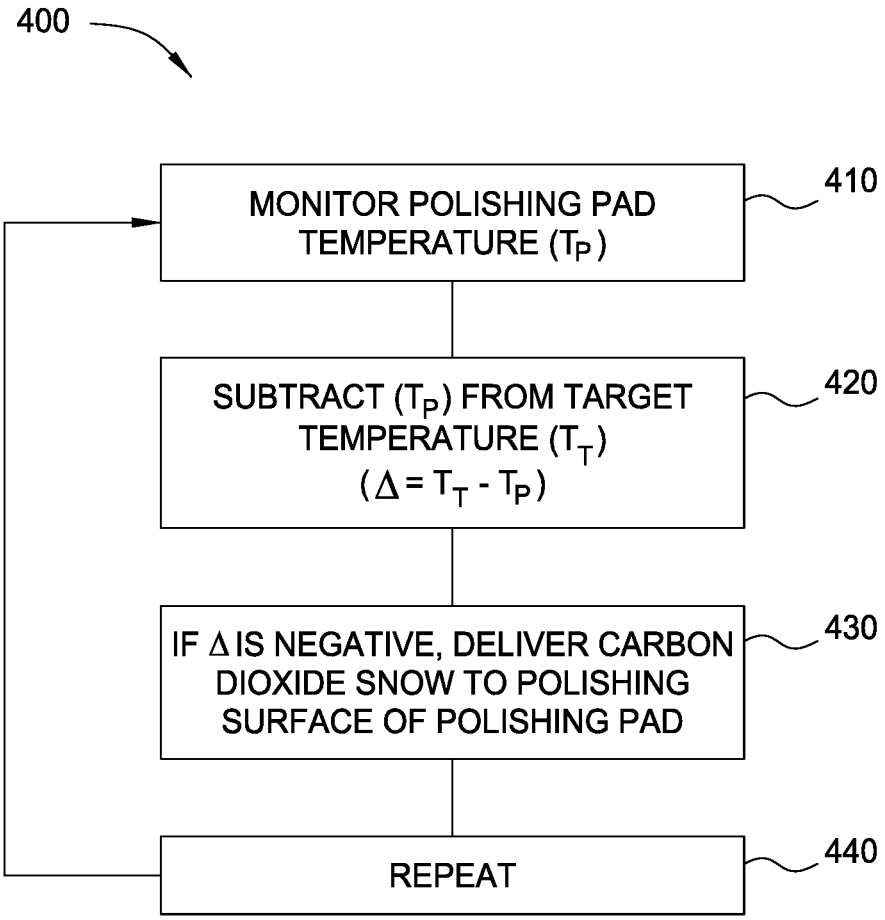
FIG. 4 is a block diagram of a control system for controlling the temperature of a polishing process according to implementations described herein.

FIG. 4 is a block diagram 400 of a method for controlling the temperature of a polishing process according to implementations described herein. The polishing process may comprise at least one of polishing the one or more substrates to remove a bulk portion of a conductive material, polishing the one or more substrates to expose a portion of an underlying barrier material, polishing the one or more substrates to remove residual conductive material from the underlying barrier material, polishing the one or more substrates to remove etch hardmask material from the underlying barrier material, polishing the one or more substrates to remove dielectric material from the underlying barrier material, and combinations thereof. In some implementations, the polishing process is performed on a single platen. At operation 410, a temperature of a polishing pad ($T_P$) is monitored. At operation 420, the polishing pad temperature ($T_P$) is subtracted from a target temperature ($T_T$) using the following formula ($\Delta=T_T-T_P$). At operation 430, if $\Delta$ is negative, carbon dioxide snow is delivered to the polishing surface of the polishing pad. At operation 440, operations 410, 420 and 430 are repeated.

Referring to FIG. 4, the temperature of substrate 122 during a CMP process can be controlled by controlling the temperature of the polishing surface 120 against which the substrate 122 is pressed during polishing. In certain implementations, the temperature of the polishing surface 120 may be controlled by exposing the polishing surface 120 to carbon dioxide snow in response to the monitored temperature to achieve a target value for the monitored temperature during the polishing process. Depositing carbon dioxide snow on the polishing surface 120 results in a decrease in the temperature of the polishing surface 120 and correspondingly decreases the temperature of the substrate 122. Thus, controller 130 can vary the application of the carbon dioxide snow to control the temperature of the polishing surface 120, for example, towards a target value such as a target value temperature or to reduce temperature variation. The target value may be determined by several factors. The target value may be 90 degrees Celsius or less (e.g., 80 degrees Celsius or less, 70 degrees Celsius or less, 60 degrees Celsius or less). The target value may be 50 degrees Celsius or less. In certain implementations, the temperature target value may be a range that is lower than a certain chosen value such as being less than 50 degrees Celsius. It may be desirable to bring the temperature much lower such as 20 degrees Celsius and provide a large buffer (of time) before the process would again approach the target value.

Application of carbon dioxide snow to the polishing surface 120 during processing can be controlled in the following manner. Using temperature sensor assembly 118, controller 130 can monitor the temperature of polishing surface 120. Controller 130 can be programmed to compare the temperature at temperature sensor assembly 118 to a predetermined target temperature profile. If the measured temperature is above the target temperature profile, controller 130 causes either the application of the carbon dioxide snow or an increase in the rate of application of the carbon dioxide snow to reduce the temperature of the polishing surface 120. If the measured temperature is below the target temperature profile, controller 130 can either cease delivery of the carbon dioxide snow or decrease the rate of application of the carbon dioxide snow to the polishing surface 120. In some implementations, the mass flow rate of carbon dioxide snow is increased when the monitored temperature increases. In some implementations, the mass flow rate of carbon dioxide snow is decreased when the monitored temperature decreases. If the measured temperature is below the target temperature profile, controller 130 can increase the pressure applied to substrate 122 by increasing the pressure in the substrate carrier head 106. If the measured temperature is below the target temperature profile, controller 130 can apply a heated fluid (e.g., heated DI water or polishing slurry) directly to the polishing surface 120 or heat the polishing surface 120 through heat conduction/convection. Thus, controller 130 can control the temperature, for example at a predetermined target value throughout the polishing process.

Although implementations of the present disclosure are generally described herein with reference to a chemical mechanical polishing chamber, it is contemplated that other processing chambers designed for polishing substrates may also benefit from implementations of the present disclosure. For example, it is contemplated that chambers for polishing lenses and other processes including both abrasive and non-abrasive slurry systems. In addition, the systems and processes described herein may be used in at least the following industries: aerospace, ceramics, hard disk drive (HDD), MEMS and Nano-Tech, metalworking, optics and electro-optics, and semiconductor, among others. Further, although implementations of the present disclosure are generally described herein with reference to carbon dioxide snow, it is contemplated that other condensed gases that can be applied as solids and cool the polishing environment by evaporation from the processing station may be used with the implementations of the present disclosure.

In summary, some of the benefits of the present disclosure include more efficient in-situ temperature control (e.g., cooling) during a polishing process. Further, the systems and methods of the present disclosure reduce the temperature of the processing environment without diluting the polishing slurry. Since polishing slurry is an expensive consumable, the systems and methods of temperature control described herein reduce the cost of ownership.

When introducing elements of the present disclosure or exemplary aspects or implementation(s) thereof, the articles "a," "an," "the" and "said" are intended to mean that there are one or more of the elements.

The terms "comprising," "including" and "having" are intended to be inclusive and mean that there may be additional elements other than the listed elements.

While the foregoing is directed to implementations of the present disclosure, other and further implementations of the disclosure may be devised without departing from the basic scope thereof, and the scope thereof is determined by the claims that follow.

The invention claimed is:

1. A method for chemical mechanical polishing (CMP), comprising:

urging one or more substrates having a material disposed thereon against a polishing surface in the presence of a polishing fluid during a polishing process to remove a portion of the material;

monitoring a temperature of the polishing surface during the polishing process; and delivering carbon dioxide snow to the polishing surface in response to the monitored temperature to maintain the temperature of the polishing surface at a target value in the presence of the polishing fluid during the polishing process.

2. The method of claim 1, wherein the target value for the monitored temperature is about 50 degrees Celsius or less.

3. The method of claim 1, wherein the polishing surface is exposed to the carbon dioxide snow when the monitored temperature is greater than the target value.

4. The method of claim 3, wherein delivering carbon dioxide snow is ceased when the monitored temperature is below the target value.

5. The method of claim 1, wherein delivering carbon dioxide snow to the polishing surface comprises increasing a mass flow rate of carbon dioxide snow when the monitored temperature increases.

6. The method of claim 1, wherein delivering carbon dioxide snow to the polishing surface comprises decreasing the mass flow rate of carbon dioxide snow when the monitored temperature decreases.

7. The method of claim 1, wherein the material is a dielectric material.

8. The method of claim 1, wherein the material is a metallic material.

9. The method of claim 1, wherein the material is a metal nitride material.

10. The method of claim 1, wherein the material is a polymer or composite.

11. A method for chemical mechanical polishing (CMP), comprising:

urging one or more substrates having a material disposed thereon against a polishing surface in the presence of a polishing fluid during a polishing process to remove a portion of the material;

monitoring a temperature of the polishing surface during the polishing process;

delivering carbon dioxide snow to the polishing surface in response to the monitored temperature to maintain the temperature of the polishing surface at a target value in the presence of the polishing fluid during the polishing process; and evaporating the carbon dioxide snow from the polishing surface.

12. The method of claim 11, wherein the carbon dioxide snow is formed by delivering carbon dioxide gas through passages where the carbon dioxide gas undergoes pressure reduction so that the carbon dioxide emerging from the passages is in a solid-state.

13. The method of claim 11, wherein the polishing process comprises at least one of: polishing the one or more substrates to remove a bulk portion of a conductive material, polishing the one or more substrates to breakthrough the conductive material and expose a portion of an underlying barrier material, polishing the one or more substrates to remove residual conductive material from the underlying barrier material, polishing the one or more substrates to remove etch hardmask material from the underlying barrier material, and polishing the one or more substrates to remove dielectric material from the underlying barrier material.

14. The method of claim 13, wherein the polishing process is performed on a single platen.

15. The method of claim 13, wherein polishing the one or more substrates to remove a bulk portion of the conductive material and polishing the one or more substrates to breakthrough the conductive material and expose a portion of an underlying material are performed on the same platen.

16. A processing station comprising:

a chamber body;

a rotatable platen disposed in the chamber body;

a substrate carrier head configured to retain a substrate against a surface of a polishing pad, wherein the substrate carrier head is disposed in the chamber body at a first location;

a carbon dioxide snow delivery system configured to deliver carbon dioxide snow to a polishing surface of the polishing pad, wherein the carbon dioxide snow delivery system is disposed in the chamber body at a second location, the second location disposed radially about a central axis of the platen and located between the first location and a third location; and a polishing fluid delivery system disposed in the chamber body at the third location, the third location disposed radially about the central axis of the platen and located between the second location and the first location; and further comprising a controller programmed to monitor a temperature of the polishing pad and deliver an amount of carbon dioxide snow to the polishing surface of the polishing pad in response to the monitored temperature.

17. The processing station of claim 16, further comprising:

a temperature sensor assembly disposed in the chamber body and positioned to monitor the temperature of the rotatable platen, the polishing pad, or both the rotatable platen and the polishing pad.

18. The processing station of claim 17, wherein the temperature sensor assembly is disposed radially about a central axis of the rotatable platen at a fourth location between the first location and the second location.

19. The processing station of claim 17, wherein the temperature sensor assembly is coupled with a carrier assembly that supports the substrate carrier head.

* * * * *